US006438785B1

(12) United States Patent
Smith

(10) Patent No.: US 6,438,785 B1
(45) Date of Patent: Aug. 27, 2002

(54) STYLING BRUSH

(76) Inventor: Jodie L. Smith, 1020 E. Main Street, Danville, IL (US) 61832

( * ) Notice: Subject to any disclaimer, the term of this patent is extended or adjusted under 35 U.S.C. 154(b) by 0 days.

(21) Appl. No.: 09/287,082

(22) Filed: Apr. 6, 1999

(51) Int. Cl.[7] ..... A46B 5/02; A46B 15/00

(52) U.S. Cl. ..... 15/160; 15/143.1; 15/186; 132/120; D4/133; D4/134; D4/136

(58) Field of Search ..... 15/160, 143.1, 15/186, 187, 167.1, 159.1; D4/133, 134, 136, 117, 132; 132/120, 150

(56) References Cited

U.S. PATENT DOCUMENTS

| | | | | | |
|---|---|---|---|---|---|
| D23,668 | S | * | 10/1894 | Wientge | D4/134 |
| D42,437 | S | * | 4/1912 | Mackenzie | D4/134 |
| 1,796,001 | A | * | 3/1931 | Church | 15/143.1 |
| D100,789 | S | * | 8/1936 | O'Donoghue | D4/134 |
| 2,084,873 | A | * | 6/1937 | Strause | 15/143.1 X |
| 2,267,670 | A | * | 12/1941 | Rosenwasser | 15/143.1 |
| 2,272,151 | A | | 2/1942 | Hertzberg | 132/120 |
| 2,414,775 | A | * | 1/1947 | Stavely | 15/143.1 |
| D157,058 | S | | 1/1950 | Langer | D4/133 |
| D169,131 | S | * | 3/1953 | Fay | D4/136 |
| 2,799,283 | A | * | 7/1957 | Kapusnyk | 132/120 |
| D180,753 | S | * | 8/1957 | Schotland | D4/133 |
| 2,817,864 | A | * | 12/1957 | Morton | 15/160 |
| D188,712 | S | * | 8/1960 | Baumgartner | D4/133 |
| 3,180,342 | A | | 4/1965 | Dietsche | 132/120 |
| D234,168 | S | | 1/1975 | Sporn | D4/133 |
| D244,568 | S | | 6/1977 | Lepisto et al. | D4/136 |
| 4,030,158 | A | | 6/1977 | Blair et al. | 15/207.2 |
| D249,909 | S | | 10/1978 | Epstein | D4/136 |
| 4,118,823 | A | | 10/1978 | Axelrod | 15/176.6 |
| D253,923 | S | | 1/1980 | Usui | D4/134 |
| 4,211,217 | A | | 7/1980 | Gueret | 15/186 |
| 4,386,620 | A | | 6/1983 | Handler | 132/313 |
| 4,406,032 | A | * | 9/1983 | Diament | 15/167.1 |
| D304,265 | S | * | 10/1989 | Boweter | D4/136 |
| D306,523 | S | | 3/1990 | Natali et al. | D4/116 |
| 5,438,726 | A | * | 8/1995 | Leite | 15/167.1 |
| D366,152 | S | | 1/1996 | Denebeim | D4/128 |
| D366,566 | S | | 1/1996 | Denebeim | D4/128 |
| 5,881,421 | A | * | 3/1999 | Ducharme | 15/167.1 |
| D423,228 | S | * | 4/2000 | Chen | D4/136 |
| 6,108,849 | A | * | 8/2000 | Weihrauch | 15/167.1 |

FOREIGN PATENT DOCUMENTS

| | | | | |
|---|---|---|---|---|
| CH | 117739 | * | 12/1926 | 15/160 |

* cited by examiner

*Primary Examiner*—Mark Spisich
(74) *Attorney, Agent, or Firm*—Michael Berns Maloney, Parkinson & Berns

(57) ABSTRACT

A styling brush for use in styling hair. The invention includes a curved head which enables the brush to fit snugly against the subject's head while the styling brush is in use, and includes a curved handle which enhances the comfort of the user of the styling brush.

4 Claims, 7 Drawing Sheets

STYLING BRUSH

BACKGROUND OF THE INVENTION

Many people today are highly concerned with their outward appearance. Television, movies, and other communication media promote an attractive outward appearance as desirable. Authors and consultants earn large incomes advising people how to make themselves look better. One feature of the outward appearance considered important by many is the appearance of the hair.

Evidence of this importance can be seen in the amount of money spent each year by advertisers and consumers on shampoos, conditioners, blow dryers, curling irons, hair restoration treatments, and the like.

A common technique used to impart an attractive appearance to the hair is the simultaneous use of a styling brush and blow dryer after shampooing. While the subject's hair is wet, the subject's hair is grasped by the styling brush close to the scalp, and then the styling brush is rotated to expose the hair to the stream of hot air from the blow dryer. The hair then is released when dry. This technique is repeated on other areas of the subject's head until all of the subject's hair is dry. The technique produces a curl which adds an appearance of thickness and volume to the hair. This appearance is known colloquially as "body," and is considered quite attractive by many people.

Another common technique used to impart an attractive appearance to the hair is a technique known in the art as teasing. After the subject's hair is dry, the user grasps a small amount of the subject's hair with one hand and hold it away from the subject's scalp. Using a brush or a teasing comb, the user brushes the hair quickly from the ends of the hair toward the roots. Teasing adds an appearance of volume to the hair. Two types of teasing are commonly used. In regular teasing, the brush or teasing comb is applied to the top side of the subject's hair. In "French Lace" teasing, the brush or teasing comb is applied to the underside of the subject's hair. French Lace teasing results in the visible portion of the subject's hair possessing a smooth appearance.

The styling brush is the critical tool in imparting an attractive appearance to the hair. The typical styling brush in use today consists of a straight, rigid spine between six inches and twelve inches in length. U.S. Pat. No. 4,118,823 and U.S. Pat. No. 4,030,158 disclose styling brushes which are typical of those in use today. The spine usually is constructed of a molded, plastic material, although it may be made from wood, insulated metal, or other material with similar rigidity and heat resistance. Approximately half of the spine is devoted to a handle with engages the hand of the user when employing the technique discussed above. The bristles which engage the hair are mounted on the remainder of the spine. The bristles typically are constructed from a flexible, heat resistant, plastic material.

The spine of the typical styling brush usually possesses either a general cylindrical or general hexahedral shape. Where the spine is generally cylindrical, such as in U.S. Pat. No. 4,386,620, bristles often are mounted on the entire circumference of the bristle portion of the spine. Where the spine is generally hexahedral, bristles often are mounted on only one side of the bristle portion of the spine. The bristle portion of this type of brush may also contain a lateral curvature to enhance the curling effect produced by the technique discussed above. U.S. Pat. No. 4,030,158 discloses a brush with a hexahedral spine and lateral curvature across the bristle portion of the spine.

Styling brushes in existence today possess several deficiencies. The first deficiency arises from the fact that the spine of the typical styling brush is straight, while the human head is curved. This makes it difficult to grasp the hair evenly, which in turn makes it difficult to achieve a result which evenly follows the shape of the subject's head. This problem is magnified on those with shorter hairstyles. The second deficiency arises from the fact that the handle of the typical styling brush is straight and not contoured to fit the hand of the user. Long term use of this type of styling brush such as by a professional hairstylist can result in discomfort or injury to the user. A desirable styling brush will addresses these deficiencies, will be reasonable in cost, will be comprised of reliable materials, and will be available in a variety of sizes to meet the hairstyling needs of subjects of different size, age, or hair type.

SUMMARY OF THE INVENTION

The present invention is a styling brush which will address the deficiencies which exist in the prior art. The present invention begins with a spine constructed of a rigid heat-resistant plastic material. Other embodiments could use wood or insulated metal for the spine. The spine possesses a general hexahedral geometry. The spine possesses a longitudinal axis and a lateral axis. The longitudinal axis extends along the longest dimension of the hexahedron. The lateral axis extends along the next longest dimension of the hexahedron. The top side of the spine and the bottom side of the spine correspond to the planes which contain the longitudinal and lateral axes.

The spine is divided into two portions, each of which comprises approximately half of the length of the spine when measured along the longitudinal axis. The first portion of the spine comprises a head, and the second portion of the spine comprises a handle. A plurality of bristles are mounted on the top side of the head. The head possesses a curvature along the longitudinal axis, the curvature causing the top surface of the first portion of the spine to be convex in shape along the longitudinal axis and causing the bottom surface of the first portion of the spine to be concave in shape along the longitudinal axis. The head also possesses a curvature along the lateral axis.

The second portion of the spine comprises a handle. In one embodiment of the invention, the handle is curved in a direction opposite the curvature of the head, such that when considered together the head and handle form a general S-shaped curve.

Alternate embodiments of the invention may include a hand stop and a thumb rest near the junction of the head and the handle, ventilation holes through the head of the brush, and a side curvature in the handle.

The present invention possesses several advantages over the prior art styling brushes when used by those skilled in the art for hair styling or hair teasing.

DESCRIPTION OF THE DRAWINGS

The above-mentioned and other features and advantages of this invention, and the manner of attaining them, will be more apparent and better understood by reference to the following description of embodiments of the invention taken in conjunction with the accompanying drawings, wherein.

DESCRIPTION OF THE INVENTION

Figure 1:
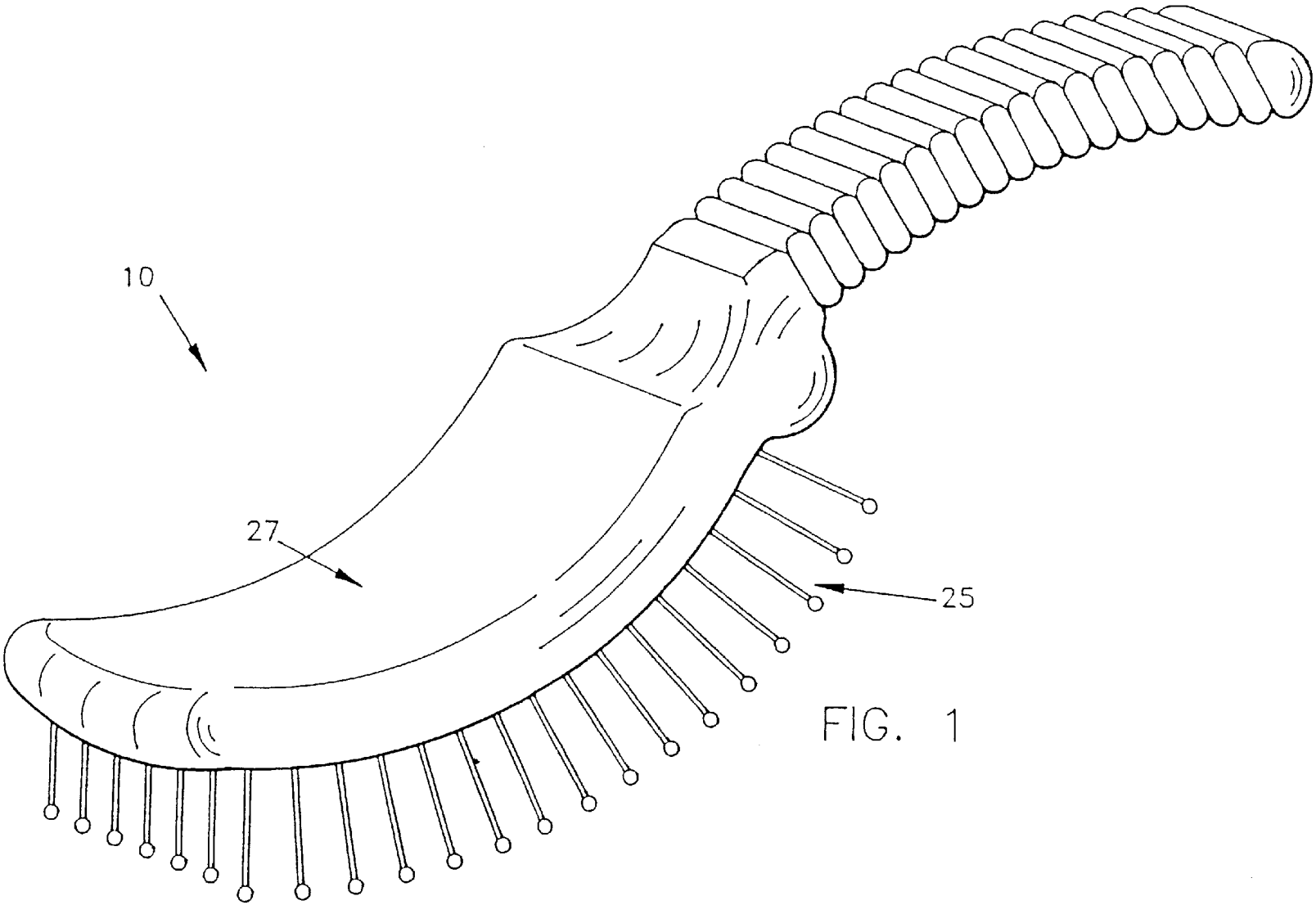
FIG. 1 shows a perspective view of one embodiment of the styling brush according to the present invention.

Accordingly, referring now to FIG. 1, there is shown a perspective view of one embodiment of the styling brush according to the present invention. Illustrated is brush 10, comprising spine 27 with a plurality of bristles 25 attached thereto. In this embodiment, spine 27 is constructed of one of many light-weight, rigid, heat-resistant, plastic materials known in the art, using methods for shaping the materials which also are known in the art. Spine 27 may be constructed of other light-weight, rigid, heat-resistant materials such as wood, insulated metal, or another material known in the art, using methods known in the art for shaping the chosen material. Bristles 25 are constructed of one of many light-weight, flexible, heat-resistant, plastic materials known in the art, using the appropriate method known in the art for shaping the chosen material. Bristles 25 are unitary in construction and comprise a long cylindrical member with a spherical member of a slightly larger diameter on one end. Bristles 25 are attached to or embedded into spine 27 by methods well known in the art, with the end of each bristle 25 opposite the end containing the spherical member being the end attached to or embedded into spine 27.

Figure 2:
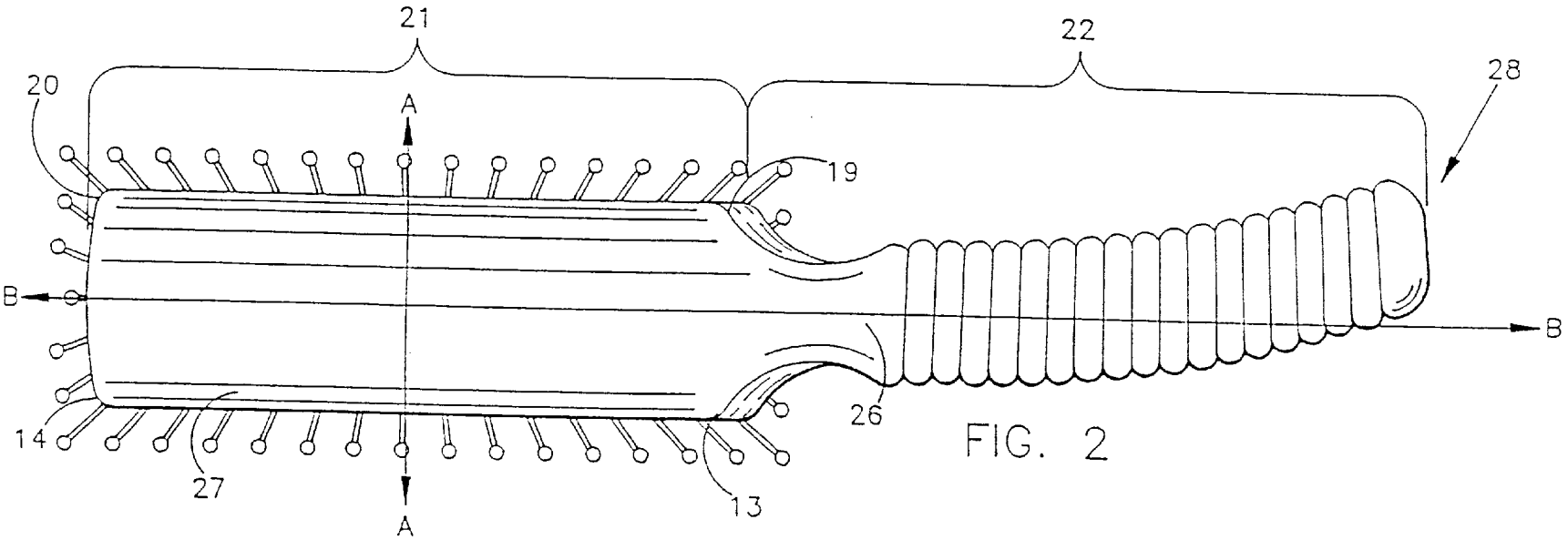
FIG. 2 shows a bottom view of the embodiment shown in FIG. 1.

FIG. 2 illustrates the bottom surface of spine 27 of brush 10 of FIG. 1. Illustrated is spine 27, comprising first portion 21 and second portion 22. First portion 21 forms the head of brush 10, and second portion 22 forms the handle of brush 10. Handle 22 includes neck 26 and endpoint 28. Head 21 includes corners 13, 14, 19, and 20. The lateral axis of spine 27 is illustrated by arrow A—A, and is defined by the line which passes through the midpoint of the bottom surface of spine 27 between corners 19 and 20, and the midpoint of the bottom surface of spine 27 between corners 13 and 14. The longitudinal axis of spine 27 illustrated by arrow B—B, and is defined by the line which passes through the midpoint of the bottom surface of spine 27 between corners 14 and 20, and extends perpendicular to and passes through the lateral axis of spine 27.

As further illustrated in FIG. 2, in the embodiment of FIGS. 1 and 2, handle 22 possesses a smoothly increasing curved shape beginning at neck 26. The curve is such that the resultant angle between the longitudinal axis and the line formed by endpoint 28 and the midpoint of a line across neck 26 which is parallel to the lateral axis will be between about 1 and 10 degrees.

Figure 3:
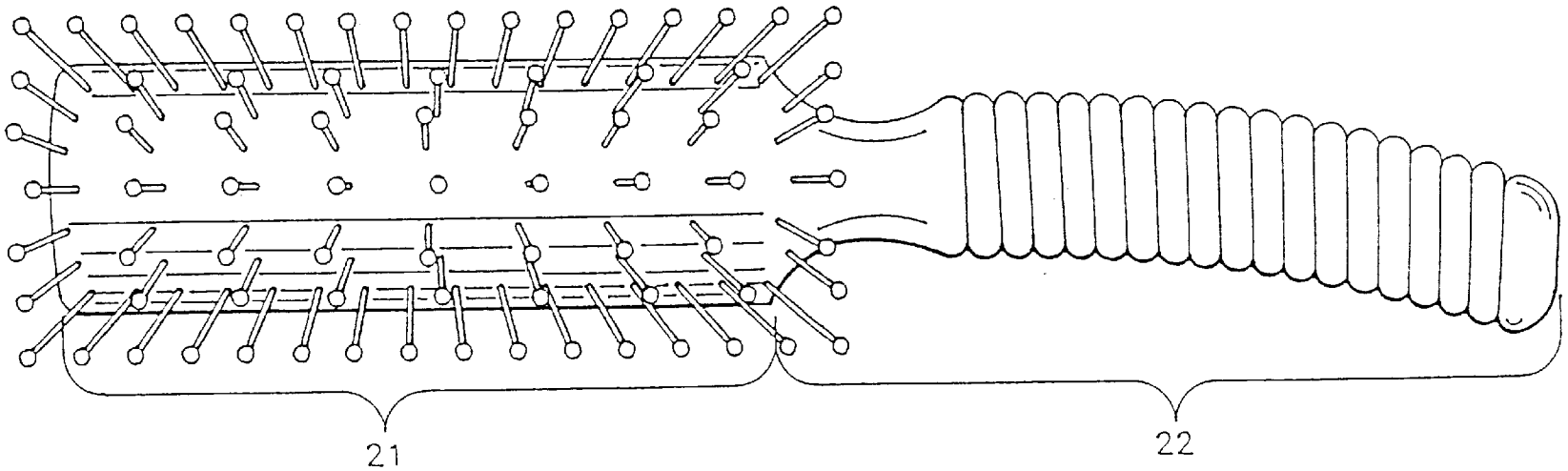
FIG. 3 shows a top view of the embodiment shown in FIG. 1.

FIG. 3 illustrates the top surface of spine 27 of brush 10 of FIG. 1. Illustrated is spine 27, with a plurality of bristles 25 attached thereto. Spine 27 comprises head 21 and handle 22. The top surface of head 21 includes a plurality of holes into which bristles 25 are inserted and held in place by one of many methods known in the art. The distribution of holes is substantially uniform across the top surface of head 21.

Figure 4:
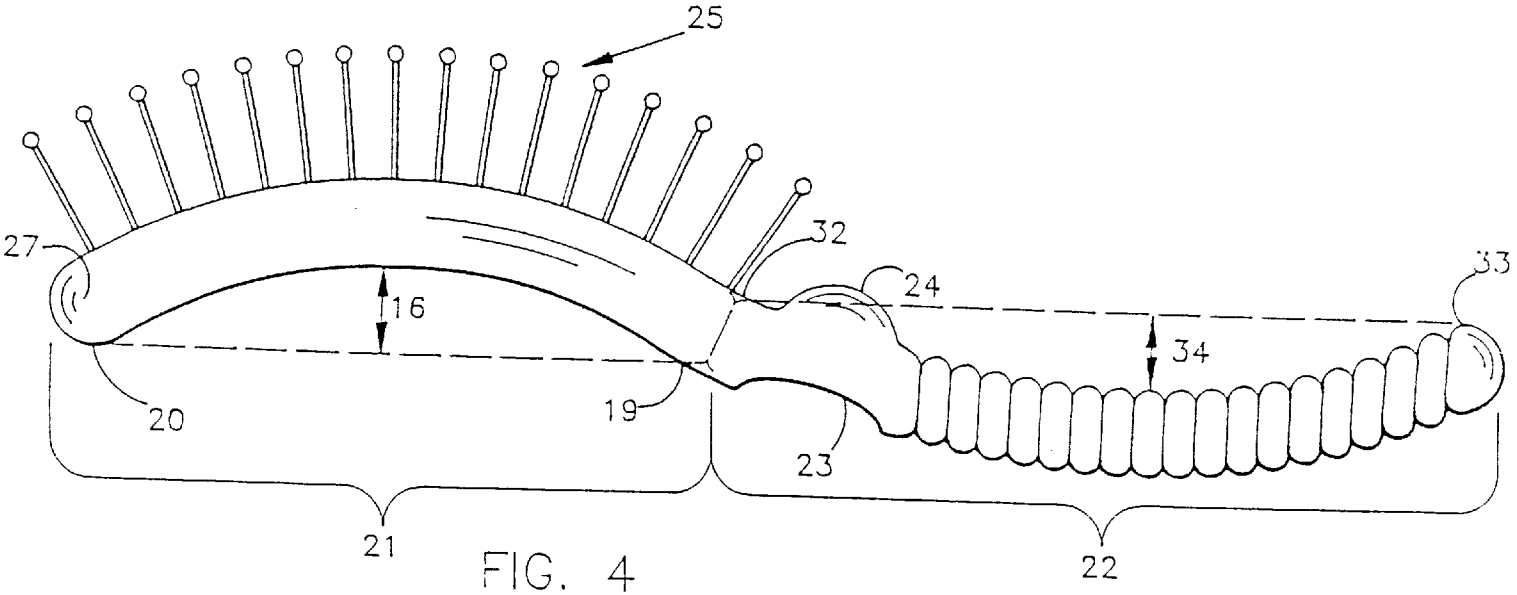
FIG. 4 shows a side view of the embodiment shown in FIG. 1, with the bristles deleted for purposes of clarity.

FIG. 4 illustrates a side view of brush 10. Illustrated is spine 27 with a plurality of bristles 25 attached thereto. As illustrated in this figure and again in FIG. 5, each bristle 25 is oriented substantially perpendicular to the top surface of spine 27 at the point where each bristle 25 intersects the top surface of spine 27.

As shown in FIG. 4, spine 27 comprises head 21 and handle 22. Head 21 includes corners 19 and 20. Head 21 follows a substantially parabolically curved shape which causes the bottom surface of head 21 to be concave in shape when viewed along the longitudinal axis, and the top surface of head 21 to be convex in shape when viewed along the longitudinal axis. Also illustrated in FIG. 4 is deflection 16, which is the greatest distance between the bottom surface of head 21 and the imaginary line between corners 19 and 20. In this embodiment, the length of the imaginary line between corners 19 and 20 is 4.0 inches, and height of deflection 16 is 0.5 inches. Alternate embodiments may employ different dimensions as long as the ratio of the length of the imaginary line between corners 19 and 20 to the height of deflection 16 is approximately 8:1.

As shown in FIG. 4, handle 22 includes thumb rest 23, hand stop 24, and endpoints 32 and 33. Handle 22 is of a substantially parabolically curved shape which causes the top surface of handle 22 to be concave in shape when viewed along the longitudinal axis, and the bottom surface of handle 22 to be convex in shape when viewed along the longitudinal axis. Endpoint 32 comprises the point along the longitudinal axis where handle 22 joins head 21. Endpoint 33 comprises the top-most point on the end of handle 22 opposite the end which joins head 21. Deflection 34 is the greatest distance between the top surface of handle 22 and the imaginary line between endpoints 32 and 33. In this embodiment, the length of the imaginary line between endpoints 32 and 33 is 4.5 inches, and height of deflection 34 is 0.25 inches. Alternate embodiments may employ different dimensions as long as the ratio of the length of the imaginary line between endpoints 32 and 33 to the height of deflection 34 is approximately 17:1.

Figure 5:
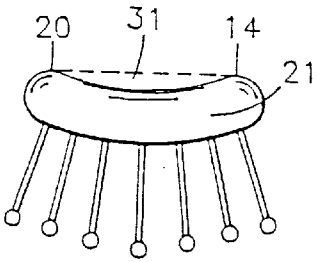
FIG. 5 shows a two dimensional end view of the head of the styling brush according to the embodiment shown in FIG. 1.

FIG. 5 illustrates the end view of spine 27 of brush 10. Illustrated are head 21, including corners 14 and 20. Head 21 follows a substantially parabolically curved shape which causes the bottom surface of head 21 to be concave in shape when viewed along the lateral axis, and the top surface of head 21 to be convex in shape when viewed along the lateral axis. Also illustrated is deflection 31, which is the greatest distance between the bottom surface of head 21 and the imaginary line formed between corners 14 and 20. In a preferred embodiment, the length of the imaginary line between corners 14 and 20 is 1.375 inches, and height of deflection 31 is 0.1875 inches. Alternate embodiments may employ different dimensions as long as the ratio of the length of the imaginary line between corners 14 and 20 to the height of deflection 31 is approximately 7.33:1.

Figure 6:
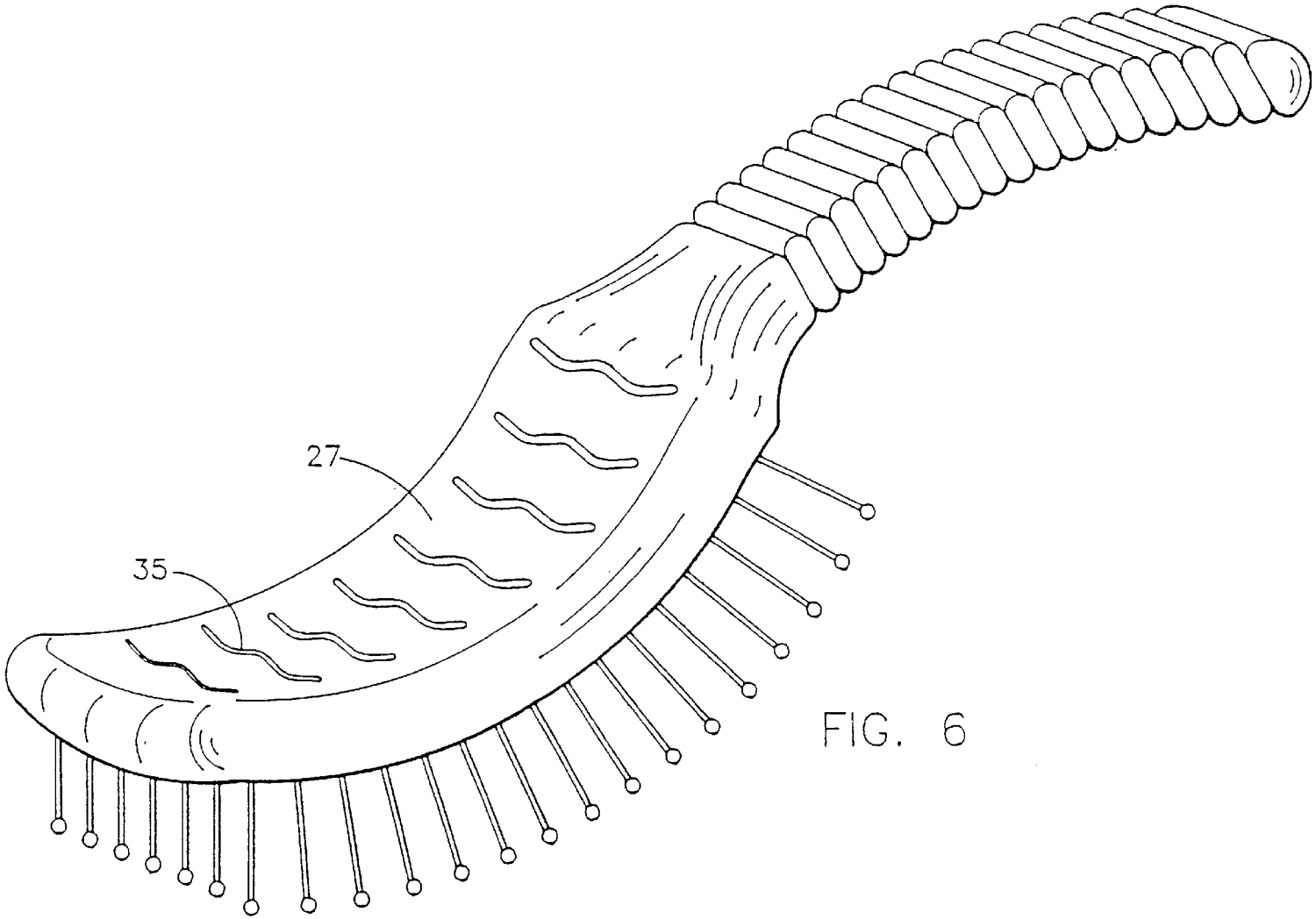
FIG. 6 shows a perspective view of one embodiment of the styling brush according to the present invention wherein ventilation apertures have been added to the embodiment shown in FIG. 1.
Figure 7:
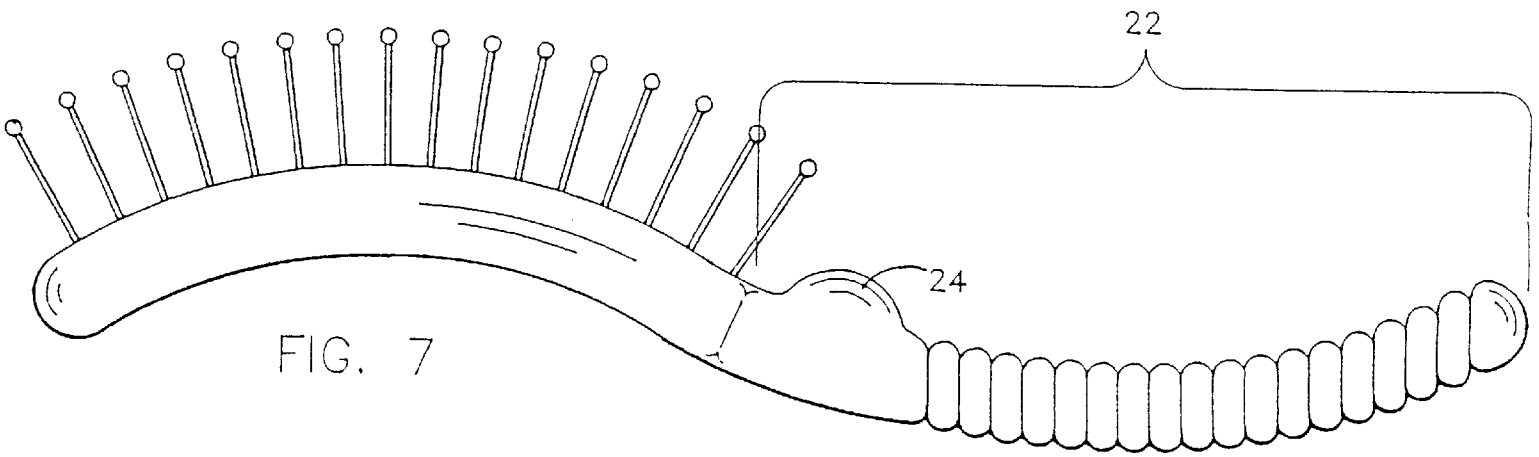
FIG. 7 shows a side view of another embodiment of the styling brush according to the present invention wherein the handle of the styling brush does not possess a thumb rest.
Figure 8:
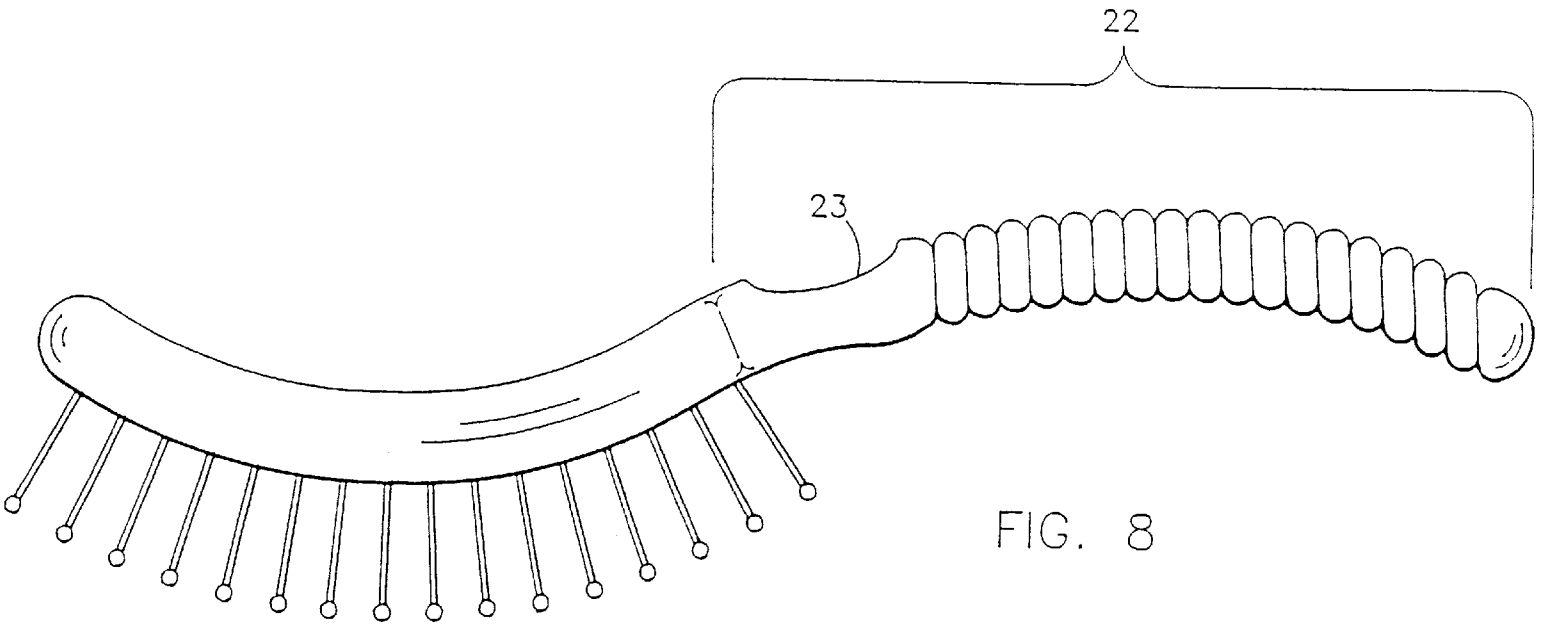
FIG. 8 shows a side view of a third embodiment of the styling brush wherein the handle of the styling brush does not possess a hand stop.
Figure 9:
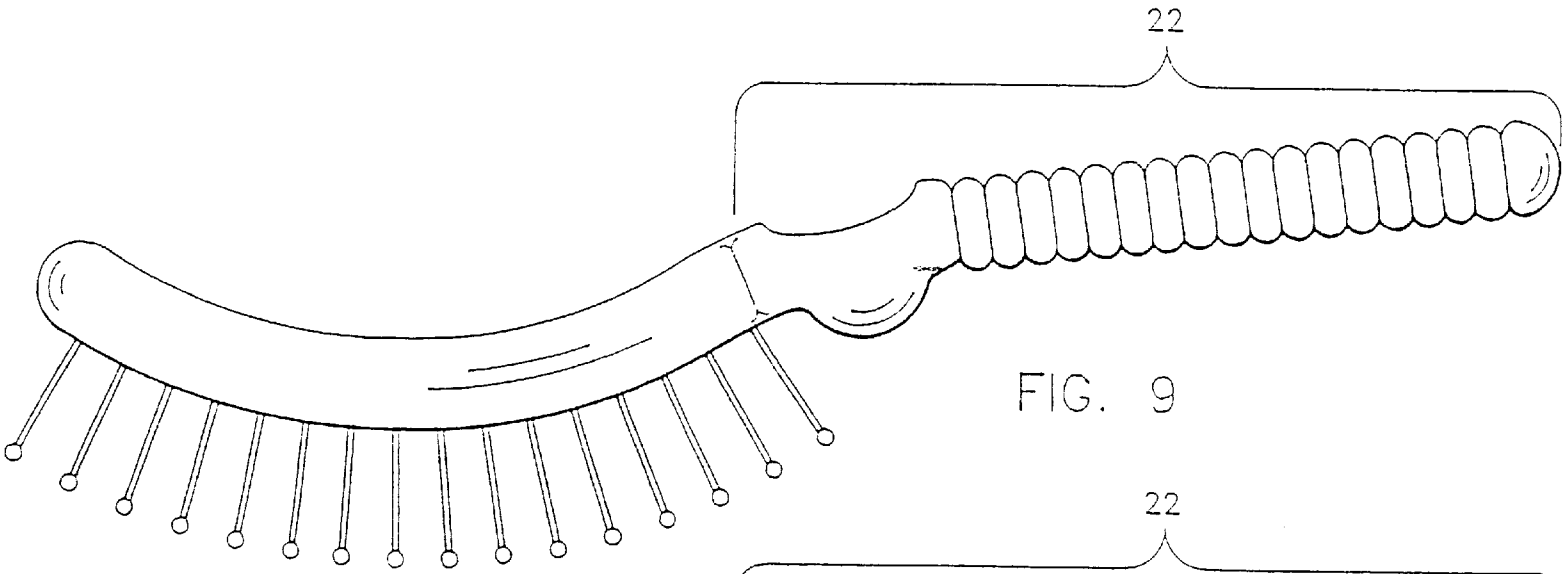
FIG. 9 shows a side view of a fourth embodiment of the styling brush wherein the handle of the styling brush is straight and not curved.
Figure 10:
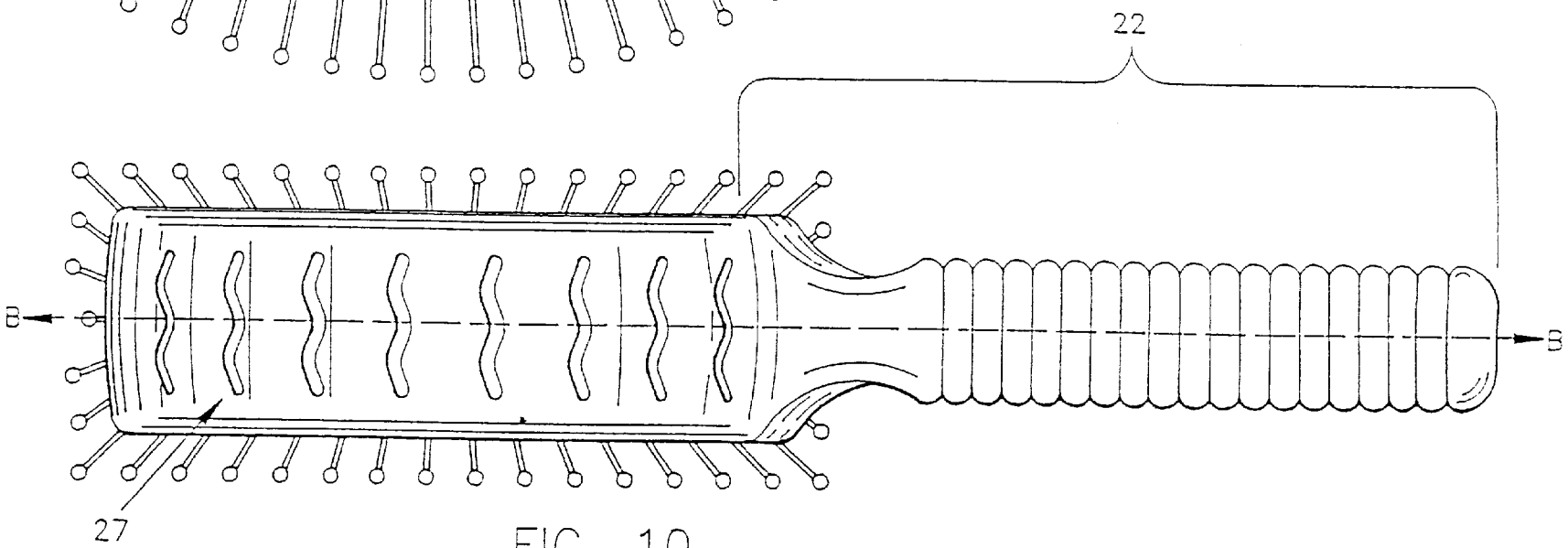
FIG. 10 shows a bottom view of yet another embodiment of the styling brush wherein the handle of the styling brush is straight and not curved.

FIGS. 6–10 illustrate alternate embodiments of the present invention. FIG. 6 illustrates an embodiment of brush 10, wherein spine 27 includes a plurality of ventilation apertures 35 therethrough. FIG. 7 illustrates an embodiment of brush 10, wherein handle 22 does not possess a thumb rest. FIG. 8 illustrates an embodiment of brush 10, wherein handle 22 does not possess a hand stop. FIG. 9 illustrates an embodiment of brush 10 wherein handle 22 does not possess deflection 34. FIG. 10 illustrates an embodiment of brush 10 wherein handle 22 is parallel to the longitudinal axis of spine 27.

It is known in the art that the simultaneous use of a styling brush and blow dryer is an effective technique for imparting an attractive appearance to the hair. While the subject's hair is wet, the subject's hair is grasped by bristles 25 close to the scalp, and then a rotative force is applied by the user to handle 22, with the effect being that brush 10 is rotated to expose the hair which has been grasped by bristles 25 to the stream of hot air from the blow dryer. The hair then is released when dry. This technique is repeated on other areas of the subject's head until all of the subject's hair is dry. The technique produces a curl which adds an appearance of thickness and volume to the hair.

An advantage of the present invention over the prior art is the incorporation of deflection 16 into head 21 of brush 10. When used with the first styling technique described above, deflection 16 permits the bottom side of brush 10 to fit more snugly against the subject's scalp during blow drying than was possible with prior art styling brushes. By using the present invention instead of a prior art styling brush, the finished hair style will be obtained with less effort and will be of higher quality for the amount of effort expended. In fact, the shape of brush 10 allows brush 10 to fit snugly against heads of different sizes, such as that of a child and an adult, and to fit against various areas of the head, such as the forehead, crown, side and bases for example.

It is also known in the art that the technique known as teasing may be used to impart an attractive appearance to the hair. After the subject's hair is dry, a small amount of the subject's hair is grasped by hand and held away from the subject's scalp. Brush 10 is oriented so that the top surface of spine 27 is directed away from the subject's scalp. Bristles 25 are engaged with the subject's hair, and then a rotative force is applied by the user to handle 22. The rotative force causes brush 10 to rotate 180° around the longitudinal axis, resulting in the top surface of spine 27 to be directed toward the subject's scalp. During rotation, the full array of bristles 25 pass through that portion of the subjects's hair which has been grasped and held away from the subject's scalp. This technique is repeated on other areas of the subject's head until the desired result is achieved.

Deflection 16 and deflection 31 cause the top surface of spine 27 to be convex along both the longitudinal and the lateral axes. The tips of bristles 25 possess a similar longitudinal and the lateral convexity. When used for teasing, the dual axis convexity of bristles 25 permit the subject's hair to be more completely and evenly engaged by bristles 25. By using the present invention instead of a prior art styling brush, the finished hair style will be obtained with less effort and will be of higher quality for the amount of effort expended. It will be appreciated by those skilled in the art that the styling method described above incorporating half turns of the present invention would be equally effective for regular teasing or French Lace teasing.

Other advantages of the present invention are the features of handle 22, including thumb rest 23, hand stop 24, deflection 34, and the curvature of handle 22 in relation to the longitudinal axis. The features of handle 22 enhance the comfort of the user, which in turn improves the result when used with the styling technique described above. Those skilled in the art also will recognize that long term, repetitive application of the styling technique described above using the prior art brushes, could cause the user to suffer a cumulative trauma disorder.

While this invention has been described as having a preferred design, the present invention can be further modified within the scope and spirit of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What I claim is:

1. A hairbrush for styling hair, comprising:

a rigid spine having a longitudinal axis, a top surface, and a bottom surface, and comprising first and second opposing portions, the first portion forming a head with a plurality of bristles attached thereto, and the second portion forming a handle;

the first portion of the spine having a first curvature along the longitudinal axis of the spine, the first curvature causing the top surface of the first portion of the spine to be convex in shape along the longitudinal axis and causing the bottom surface of the first portion of the spine to be concave in shape along the longitudinal axis; and the second portion of the spine having a second curvature along the longitudinal axis of the spine wherein the first and second curvatures collectively form an S-shaped curve; and wherein the second potion of the spine further comprises a third curvature beginning near the junction of the first and second portions of the spine and extending through the distal end of the second portion of the spine, the third curvature being such that the resultant angle between the longitudinal axis and an imaginary line extending from the midpoint of a line across the narrowest portion of the proximal end of the second portion of the spine through the distal end of the second portion of the spine is about 1 degree and about 10 degrees.

2. A hairbrush for styling hair, comprising:

a rigid spine having a longitudinal axis, a top surface, and a bottom surface, and comprising first and second opposing portions, the first portion forming a head with a plurality of bristles attached thereto, and the second portion forming a handle;

the first portion of the spine having a first curvature along the longitudinal axis of the spine, the first curvature causing the top surface of the first portion of the spine to be convex in shape along the longitudinal axis and causing the bottom surface of the first portion of the spine to be concave in shape along the longitudinal axis; and the second portion of the spine having a second curvature along the longitudinal axis of the spine wherein the first and second curvatures collectively form an S-shaped curve; and wherein the spine includes a lateral axis and wherein the first portion of the spine is curved along the lateral axis of the spine causing the top surface of the first portion of the spine to be convex in shape along the lateral axis and the bottom surface of the first portion of the spine to be concave in shape along the lateral axis; and wherein the second portion of the spine further comprises a third curvature beginning near the junction of the first and second portions of the spine and extending through the distal end of the second portion of the spine, the third curvature being such that the resultant angle between the longitudinal axis and an imaginary line extending from the midpoint of a line across narrowest portion of the proximal end of the second portion of the spine through the distal end of the second portion of the spine is between about 1 degree and about 10 degrees.

3. A hairbrush for styling hair, comprising:

a rigid spine having a longitudinal axis, a top surface, and a bottom surface, and comprising first and second opposing portions, the first portion forming a head with a plurality of bristles attached thereto, and the second portion forming a handle;

the first portion of the spine having a first curvature along the longitudinal axis of the spine, the first curvature causing the top surface of the first portion of the spine to be convex in shape along the longitudinal axis and causing the bottom surface of the first portion of the spine to be concave in shape along the longitudinal axis; and the second portion of the spine having a second curvature along the longitudinal axis of the spine wherein the first and second curvatures collectively form an S-shaped curve; and wherein the spine includes a lateral axis and wherein the first portion of the spine is curved along the lateral axis of the spine causing the top surface of the first portion of the spine to be convex in shape along the lateral axis and the bottom surface of the first portion of the spine to be concave in shape along the lateral axis; and wherein the spine further comprises a thumb rest formed into the spine, the thumb rest located on the bottom surface of the spine near the junction f the first and second portions of the spine; and wherein the second portion of the spine further comprises a third curvature beginning near the junction of the first and second portions of the spine and extending through the distal end of the second portion of the spine, the third curvature being such that the resultant angle between the longitudinal axis and an imaginary line extending from the midpoint of a line across narrowest portion of the proximal end of the second portion of the spine through the distal end of the second portion of the spine is between about 1 degree and about 10 degrees.

4. A hairbrush for styling hair, comprising:

a rigid spine having a longitudinal axis, a top surface, and a bottom surface, and comprising first and second opposing portions, the first portion forming a head with a plurality of bristles attached thereto, and the second portion forming a handle;

the first portion of the spine having a first curvature along the longitudinal axis of the spine, the first curvature causing the top surface of the first portion of the spine to be convex in shape along the longitudinal axis and causing the bottom surface of the first portion of the spine to be concave in shape along the longitudinal axis; and the second portion of the spine having a second curvature along the longitudinal axis of the spine wherein the first and second curvatures collectively form an S-shaped curve; and wherein the spine further comprises a thumb rest formed into the spine, the thumb rest located n the bottom surface of the spine near the junction of the first and second portions of the spine; and wherein the second portion of the spine further comprises a third curvature beginning near the junction of the first and second portions of the spine and extending through the distal end of the second portion of the spine, the third curvature being such that the resultant angle between the longitudinal axis and an imaginary line extending from the midpoint of a line across narrowest portion of the proximal end of the second portion of the spine through the distal end of the second portion of the spine is between about 1 degree and about 10 degrees.

* * * * *